US006769345B2

(12) United States Patent
Grange et al.

(10) Patent No.: US 6,769,345 B2
(45) Date of Patent: Aug. 3, 2004

(54) CONTAINER FOR PROPELLANT CHARGE MODULES

(75) Inventors: Gilles Grange, La Fouilleuse (FR); Yves Martinez, Saint-Chamond (FR); Jean-Philippe Delaire, Saint-Rémy les Chevreuses (FR); Joël Roche, Saint-Etienne (FR); Claude Avrard, Saint-Etienne (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 10/136,330

(22) Filed: May 2, 2002

(65) Prior Publication Data

US 2002/0170421 A1 Nov. 21, 2002

(30) Foreign Application Priority Data

May 17, 2001 (FR) ..... 01 06493

(51) Int. Cl.[7] ..... F41F 3/04
(52) U.S. Cl. ..... 89/1.816; 89/1.806; 89/1.801
(58) Field of Search ..... 89/1.801, 1.802, 89/1.804, 1.806, 1.815, 1.816, 1.817, 45; 206/3, 303, 445, 496

(56) References Cited

U.S. PATENT DOCUMENTS 3,558,007 A 1/1971 Hans-Dieter et al.

FOREIGN PATENT DOCUMENTS

| | | |
|---|---|---|
| DE | 87 07 289 U | 7/1987 |
| EP | 0 388 211 A1 | 9/1990 |
| FR | 1.423.797 | 1/1966 |
| FR | 1.423.797 A | 1/1966 |
| FR | 1.601.106 | 8/1970 |
| FR | 1.601.106 A | 8/1970 |
| FR | 2 356 119 A | 1/1978 |
| FR | 2 356 199 | 1/1978 |
| GB | 1 285 481 | 8/1972 |

*Primary Examiner*—Michael J. Carone
*Assistant Examiner*—Troy Chambers
(74) *Attorney, Agent, or Firm*—Oliff & Berridge, PLC

(57) ABSTRACT

The invention relates to a container for propellant charge modules to be loaded into a weapon using conveyance means.

It comprises protection means insulating said modules from the conveyance means, constituted by a rigid tubular body, a sheath intended to receive the modules and means to block the modules in the sheath. The sheath is made of a deformable material. The blocking means ensure the deformation of the sheath to immobilize the modules.

Application to charge module conveyance.

8 Claims, 2 Drawing Sheets

CONTAINER FOR PROPELLANT CHARGE MODULES

BACKGROUND OF THE INVENTION

The technical scope of the present invention is that of containers for propellant charge modules.

To ensure the transportation of propellant charges in modular form, that is blocks of agglomerated propellant powder, these are placed in suitable packing. However, when a weapon is required to be loaded using these modules the pyrotechnic risks must be controlled during all the transportation phases. At present, loading is carried out by manipulating the caseless blocks over very short distances. Thus, a system to feed a cannon with ammunition constituted by a projectile and charge modules taken from a magazine is known. This system is described in patent FR-A-2 764 055 and notably comprises a magazine containing modules placed near to the cannon that are transferred using a pincer onto a loading tray then carefully pushed into the cannon chamber. There is no question of transferring these modules over a greater distance using conveyance means nor is it possible to manipulate them.

SUMMARY OF THE INVENTION

The aim of the present invention is to propose means to manipulate the propellant charge modules whilst providing a high level of safety between a storage place at a distance from the weapon loading position.

The invention thus relates to a container for propellant charge modules to be loaded in a weapon using conveyance means, wherein it comprises protection means, insulating said modules from the conveyance means, constituted by a rigid tubular body, a sheath in which to receive the modules and means to block the modules in the sheath.

According to a first embodiment, the sheath is made of a deformable material.

According to another embodiment, the blocking means ensure the deformation of the sheath to immobilize the modules.

According to yet another embodiment, the blocking mean are constituted by pads pressing on the sheath.

According to yet another embodiment, the pads are subject to the action of control means integral with the body.

According to yet another embodiment, the control means are constituted by springs connected to a control bar equipped with a manoeuvring organ.

According to yet another embodiment, the body is provided with a longitudinal slit allowing a passage for the organ introducing the modules into the sheath.

According to yet another embodiment, the body has a crown at one end that allows said container to be handled during its transportation between the replenishment position and the weapon loading position.

According to yet another embodiment, the body is metallic and the sheath is made of a plastic material.

According to yet another embodiment, the container encloses two to six propellant charge modules.

One great advantage of the invention lies in the fact that the propellant charge modules are immobilized whatever the movements of the container when they are being taken up by the conveyance means. The modules are thus not subject to any displacement during their manipulation by the conveyance organs.

Another advantage lies in the fact that safety is controlled since the risk of ignition by friction is eliminated.

Yet another advantage lies in the fact that the effect of any pyrotechnic incident is maintained and directed toward the ends of the container.

BRIEF DESCRIPTION OF THE DRAWINGS

Other characteristics, particulars and advantages of description given hereafter by way of illustration and in reference to the appended drawings, in which.

DETAILED DESCRIPTION OF PREFERRED EMBODIMENTS

The propellant charge module container is intended to be integrated into a chain integrating high rate automatic conveyance means from a magazine to the weapon implementing this type of charge. It is understood that when this distance is great, any deterioration to the projectiles must be avoided as must any falls or shocks. Taking up the container by gripping means must not cause any interference to the projectiles.

Figure 1:
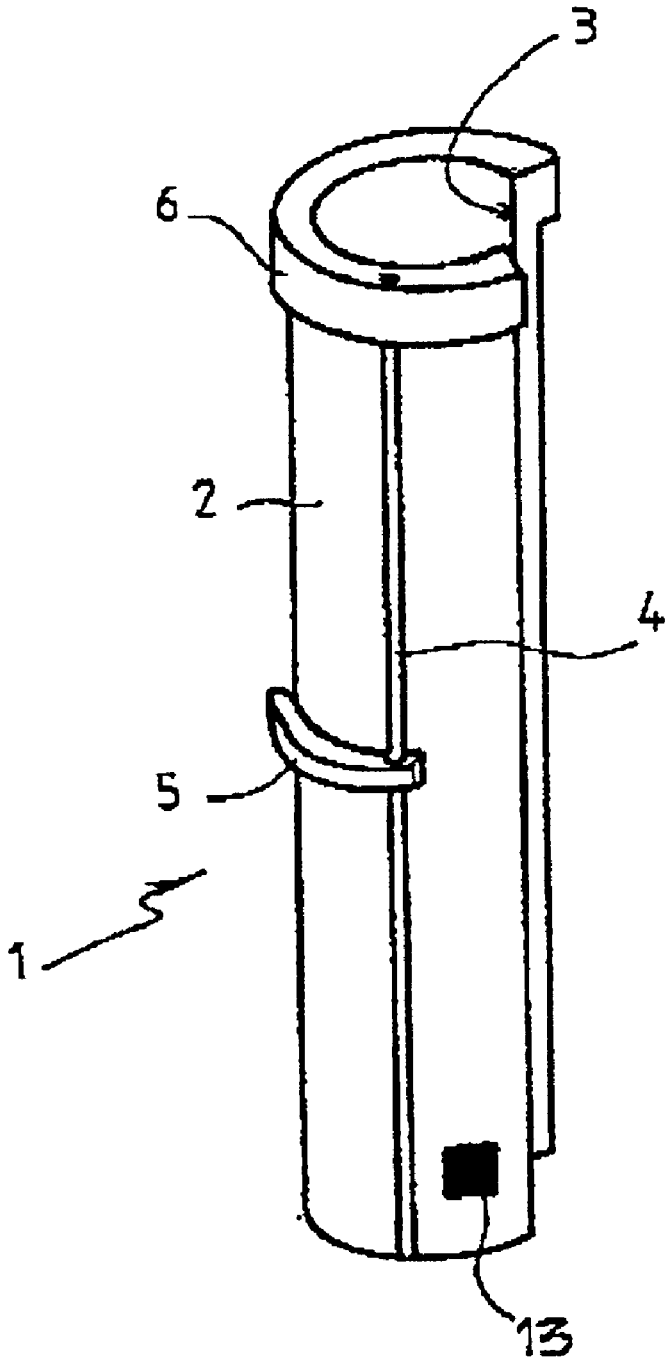
FIG. 1 represent a schematic view of the container according to the invention.

FIG. 1 shows a container 1 in the form of a tubular body 2 open at both ends. This body must be made of a material that is rigid enough to be able to withstand the shocks to which it is subjected. This body may be made, for example, of metal. The body 2 is provided with a slit 3 along the body's generatrix that allows access to the inside. The body incorporates a crown 6 at one of its ends on which gripping and manipulation means (not shown) will act to carry and block the container during its transportation. Thus, the container 1 may be transferred from a first storage magazine to an intermediate magazine by means of a transfer chain, then from the intermediate magazine to a loading drum in which it may be immobilized to ensure the transfer of the projectile into the weapon chamber. We can see that during all these transfer and handling operations, it is essential for the modules to be protected and removed from any direct action.

The container 1 is provided with a longitudinal bar 4 integral with a manoeuvring organ 5 as will be explained in greater detail hereafter. The container 1 may additionally incorporate an electromagnetic circuit 13 allowing its contents to be recognized, data to be memorized even in the event of an electrical power cut, and thus the ammunition configuration of the feeding system to be recognized at any moment and in particular when switching on. The data may be read at certain stages in the transfer of the container using a reader implanted according to the needs of the ammunition management system.

Figure 2:
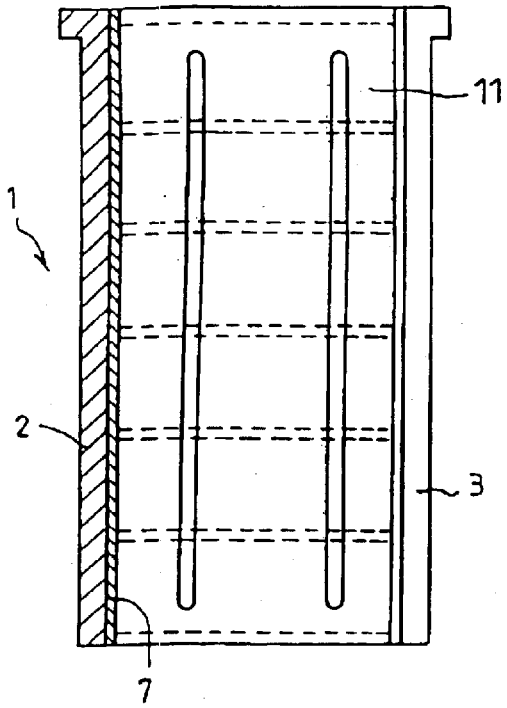
FIG. 2 is a longitudinal section of the container.

FIG. 2 shows a longitudinal section view of the container 1 whose body 2 can be seen in the left part and the slit 3 in the right part of the Figure. Inside this body there is a sheath 7 made of a flexible material, for example a plastic material. A material will preferably be chosen that is able to deform under the action of blocking means and take up its initial shape when no longer subject to the action of said means. This sheath 7 may be fitted either in an arrangement offering no play with respect to the body 1 or with a small amount of play to constitute the housing for the tightening organs shown in FIG. 4.

Figure 3:
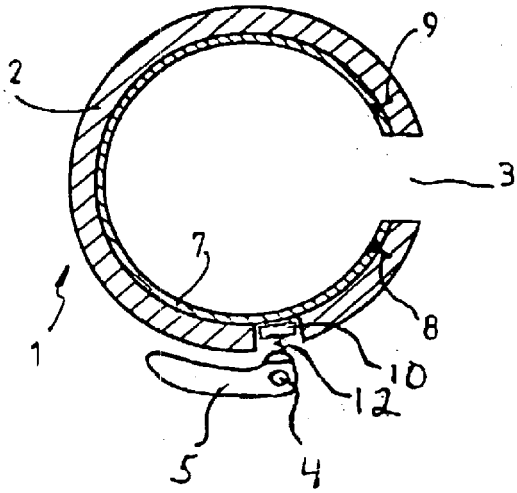
FIG. 3 is a cross section of the container.

FIG. 3 shows a cross section of the container 1 where the body 2 and sheath 7 can be seen to be joined by pins 8 and 9 along the edges of the slit 3. This type of fastening allows the greatest contact area to be left between these two elements.

Figure 4:
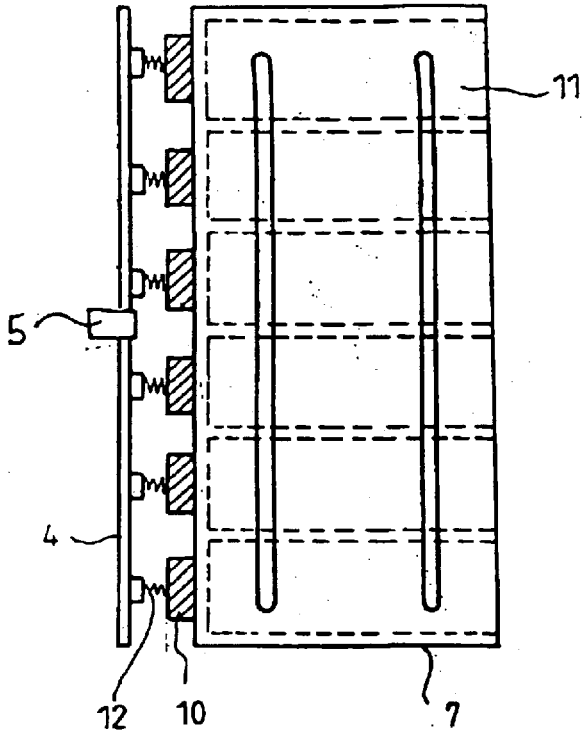
FIG. 4 is a cross section showing the blocking means for the modules.

FIG. 4 shows an embodiment of the means to block the charge modules 11 in the container. In FIG. 4, the body 2 of the container 1 has been removed for clarity. There are six of these modules in the example shown, but a lesser number may be provided. These modules 11 are introduced into the sheath 7 using a comb that is part of the gripping system (not shown) whose arms pass through the slit 3 to introduce them into the sheath 7. They are introduced using a translational movement. The container is fitted with blocking means 11 for the modules that are constituted by pads 10 activated by the bar 4 and intended to exert a thrust by means of springs 12. These pads 10 press on the outer surface of the sheath 7 and compress it thereby blocking each of the modules 11. As indicated above, the bar 4 is a control bar to exert a release force on the pads 10 by means of the springs 12. The lever 5 integral with the bar 4 merely has to be activated in order to release the pads thus enabling the modules to be introduced in the container or to be released when required to be taken to load the weapon, for example by means of a pusher.

The container according to the invention allows the modules to be supported and immobilized in a failsafe manner in whatever position in space and during all the conveyance and/or hoisting phases, provides guidance over a continuous smooth (non abrasive) surface constituted by the sheath, and allows the pads to be released reliably and simply, and finally provides insulation against nominal and/or accidental external aggressions. Even in the event of inadvertent ignition, the unwanted effects are directed along the longitudinal axis of the container towards its ends.

What is claimed is:

1. A container for propellant charge modules to be loaded in a weapon, wherein the container comprises:

protection means in the form of a rigid tubular body;

a sheath inside the rigid tubular body made of a deformable material, in which to receive said modules; and, blocking means to block said modules in said sheath by deforming said sheath to immobilize said modules in said sheath.

2. A container according to claim 1, wherein said blocking means are constituted by pads pressing on said sheath.

3. A container according to claim 2, further comprising control means, wherein said control means is mounted to said body and releasably actuates said pads against said sheath.

4. A container according to claim 3, wherein said control means are constituted by springs connected to a control bar equipped with a maneuvering organ.

5. A container according to claim 1, wherein said body is provided with a longitudinal slit allowing a passage for introducing said modules into said sheath.

6. A container according to claim 5, wherein said body has a crown at one end that allows said container to be handled during transportation between a replenishment position and a loading position of said weapon.

7. A container according to claim 1, wherein said body is metallic and said sheath is made of a plastic material.

8. A container according to claim 1, wherein the container encloses two to six propellant charge modules.

* * * * *